United States Patent [19]

Morita

[11] Patent Number: 4,862,585

[45] Date of Patent: Sep. 5, 1989

[54] APPARATUS FOR ATTACHING TOP END STOPS TO SLIDE FASTENER CHAIN

[75] Inventor: Toyoo Morita, Uozu, Japan

[73] Assignee: Yoshida Kogyo K. K., Tokyo, Japan

[21] Appl. No.: 229,850

[22] Filed: Aug. 8, 1988

[30] Foreign Application Priority Data

Aug. 11, 1987 [JP] Japan ..... 62-201077

[51] Int. Cl.[4] ..... A41H 37/06

[52] U.S. Cl. ..... 29/767; 29/408

[58] Field of Search ..... 29/767, 766, 33.2, 408

[56] References Cited

U.S. PATENT DOCUMENTS

| | | | |
|---|---|---|---|
| 3,504,418 | 4/1970 | Perlman . | |
| 3,530,563 | 9/1970 | Maeda | 29/767 |
| 3,689,980 | 9/1972 | Oyama | 29/767 |
| 4,217,685 | 8/1980 | Seki | 29/767 |
| 4,332,071 | 6/1982 | Takahashi | 29/767 |
| 4,462,154 | 7/1984 | Morita | 29/766 |
| 4,697,319 | 10/1987 | Umino | 29/767 |

FOREIGN PATENT DOCUMENTS

| | | |
|---|---|---|
| 0030707 | 10/1981 | European Pat. Off. . |
| 0161647 | 11/1985 | European Pat. Off. . |
| 0099064 | 6/1987 | European Pat. Off. . |
| 0213599 | 11/1987 | European Pat. Off. . |
| 2409719 | 6/1979 | France . |
| 45-16624 | 6/1970 | Japan . |

*Primary Examiner*—P. W. Echols

*Attorney, Agent, or Firm*—Hill, Van Santen, Steadman & Simpson

[57] ABSTRACT

A pair of top end stops is attached to respective beaded edges of a pair of stringer tapes of a slide fastener chain which is fed along a feed path. A punch and die assembly disposed above the feed path has a pair of pockets for gripping the top end stops, respectively. The die assembly being movable between a horizontal position for receiving the top end stops and a vertical position directly above an attaching position for attaching the top end stops to the stringer tapes. The punch and die assembly is moved from the horizontal position to the vertical position, and then lowered from the vertical position into the attaching position across the feed path. The stringer tapes are spread apart from each other by a thrust lever, and then the punch and die assembly is pressed by a pusher rod to clinch the top end stops gripped in the pockets on the respective beaded edges of the stringer tapes.

5 Claims, 6 Drawing Sheets

APPARATUS FOR ATTACHING TOP END STOPS TO SLIDE FASTENER CHAIN

BACKGROUND OF THE INVENTION

1. Field of the Invention:

The present invention relates to an apparatus for attaching top end stops to an elongate slide fastener chain with equally spaced element-free spaces defined therein after separable end stops and sliders are mounted while the slide fastener chain is being longitudinally fed along in one direction.

2. Description of the Prior Art:

One known apparatus for applying top end stops to an elongate slide fastener chain while the chain is being progressively processed into a succession of individual slide fasteners is disclosed in Japanese Patent Publication No. 45-16624, for example. The disclosed apparatus includes a top end stop holder composed of a main bar and an auxiliary bar for jointly gripping a pair of top end stops. The top end stop holder receives a pair of top end stops when it is held in a horizontal position, and is then lowered along an arcuate path into a feed path of the slide fastener chain. Then, the inner longitudinal beaded edges of the stringer tapes are fitted respectively in the top end tops held by the top end stop holder from a cut end of the fastener chain by moving the fastener chain with grippers, after which the top end stops are clamped by staking on the beaded edges of the stringer tapes.

The known top end stop applying apparatus is so constructed as to apply top end stops to inner longitudinal tape edges of the slide fastener chain which have been threaded through the top end stops from a cut end of the slide fastener chain after severance of the slide fastener chain. With this construction, the known apparatus is not readily applicable to a top-end-stop application to which the present invention pertains, in which top end stops are applied through an element-free space to a continuous slide fastener chain in advance to severance of the slide fastener chain. If the known apparatus were employed in the present top-end-stops application, then problems would arise, as follows.

Since the top end stop holder descends along the arcuate path, the stringer tapes should be spaced for a long length so that meshing rows of coupling elements mounted thereon are disengaged from each other for a great length along the stringer tapes. Accordingly, the rows of coupling elements will subsequently have to be engaged again by a mounted slider for the same length. As a result, the conventional apparatus has been poor in efficiency, and hence the efficiency of the entire process of finishing slide fasteners has been low.

SUMMARY OF THE INVENTION

In view of the aforesaid drawbacks of the conventional apparatus, it is an object of the present invention to provide an apparatus for attaching top end stops to a slide fastener chain highly efficiently through an element-free space by minimizing the degree to which the meshing rows of coupling elements are disengaged from each other.

According to the present invention, there is provided an apparatus for attaching a pair of top end stops to respective beaded edges of a pair of stringer tapes of a slide fastener chain which is fed along a feed path, the apparatus comprising: a punch and die assembly disposed above the feed path and having a pair of pockets for gripping the top end stops, respectively, the punch and die assembly being movable between a first position for receiving the top end stops and a second position directly above an attaching position for attaching the top end stops to the stringer tapes; moving means for moving the the punch and die assembly from the first position to the second position; lifting/lowering means for moving the punch and die assembly vertically between the second position and the attaching position across the feed path; a thrust lever disposed below the feed path for spreading the stringer tapes away from each other; and a pusher rod disposed below the feed path for pressing the punch and die assembly to clinch the top end stops gripped in the pockets on the respective beaded edges of the stringer tapes.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 8:
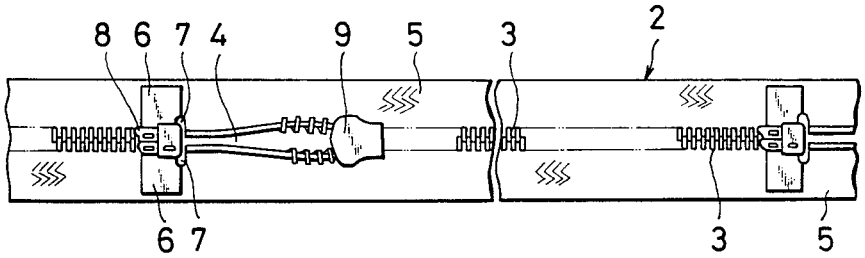
FIGS. 8 and 9 are fragmentary plan views showing the manner in which top end stops are applied to a slide fastener chain.

FIG. 8 shows an elongate continuous slide fastener chain 2 to which top end stops 1 (FIG. 9) will have to be attached so that the slide fastener chain 2 can be finished into a separable slide fastener. The slide fastener chain 2 comprises a pair of stringer tapes 5 and a pair of intermeshing rows of coupling elements 3 mounted on respective inner confronting beaded edges of the stringer tapes 5. The slide fastener chain 2 has a plurality of longitudinally spaced element-free spaces or gaps 4 of certain length. A pair of reinforcing films 6 is attached to the stringer tapes 5 transversely thereacross at one end of each of the element-free spaces 4. The slide fastener chain 2 also has a transverse slot 7 defined in both the stringer tapes 5 and the reinforcing films 6 near each element-free space 4, and a separable bottom end stop 8 mounted on each pair of reinforcing films 6. A slider 9 is mounted on each length of the rows of coupling elements 3.

Figure 9:
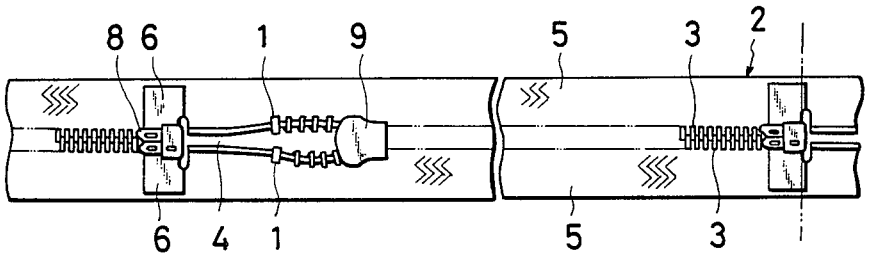
Figure 10:
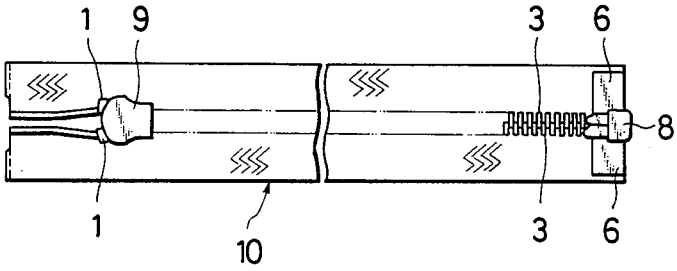
FIG. 10 is a fragmentary plan view of a finished slide fastener.

According to the present invention, the top end stops 1 each in the shape of a U are attached to respective upper ends of the rows of coupling elements 3 as shown in FIG. 9 by clamping the top end stops and subsequently staking them on the respective beaded edges of the stringer tapes 5. After the top end stops 1 have been applied, the stringer tapes 5 are cut off across the element-free spaces 4, thereby producing a separable slide fastener 10 shown in FIG. 10.

Figure 1:
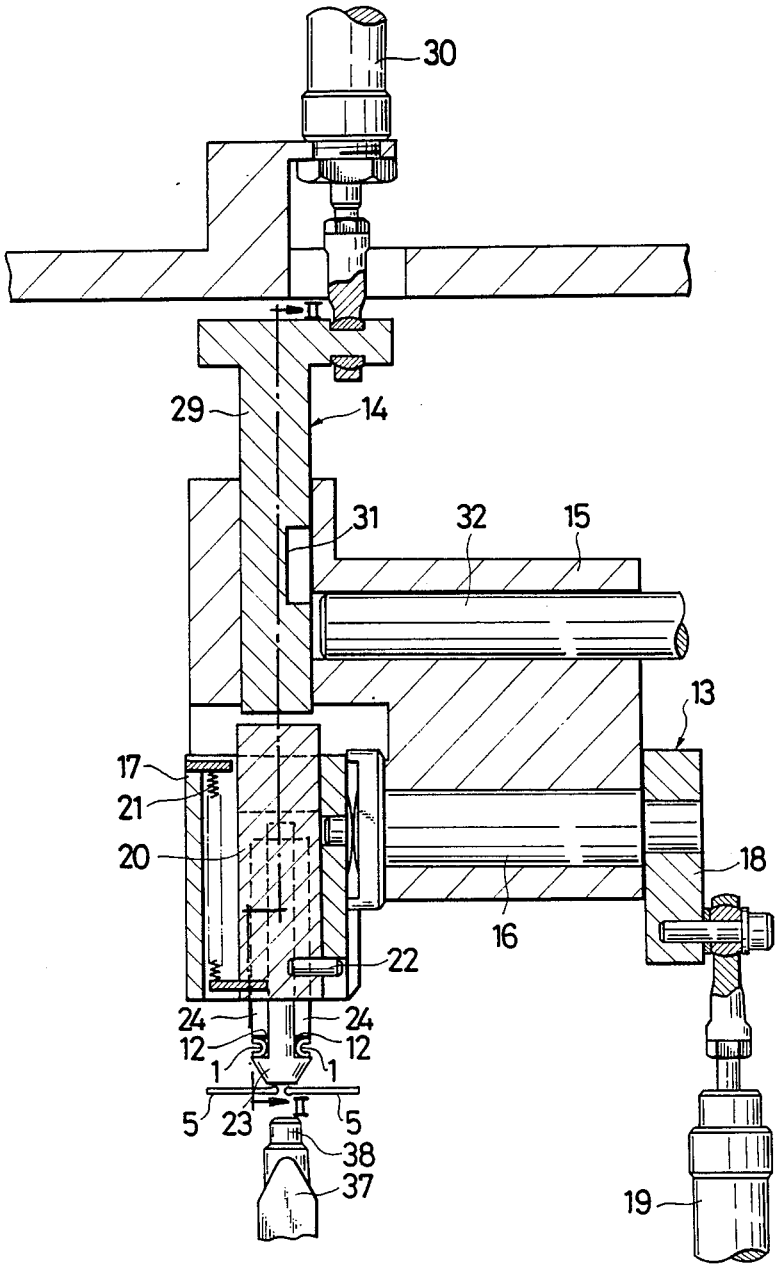
FIG. 1 is a fragmentary sectional front elevational view of an apparatus for attaching top end stops to a slide fastener chain according to the present invention.
Figure 2:
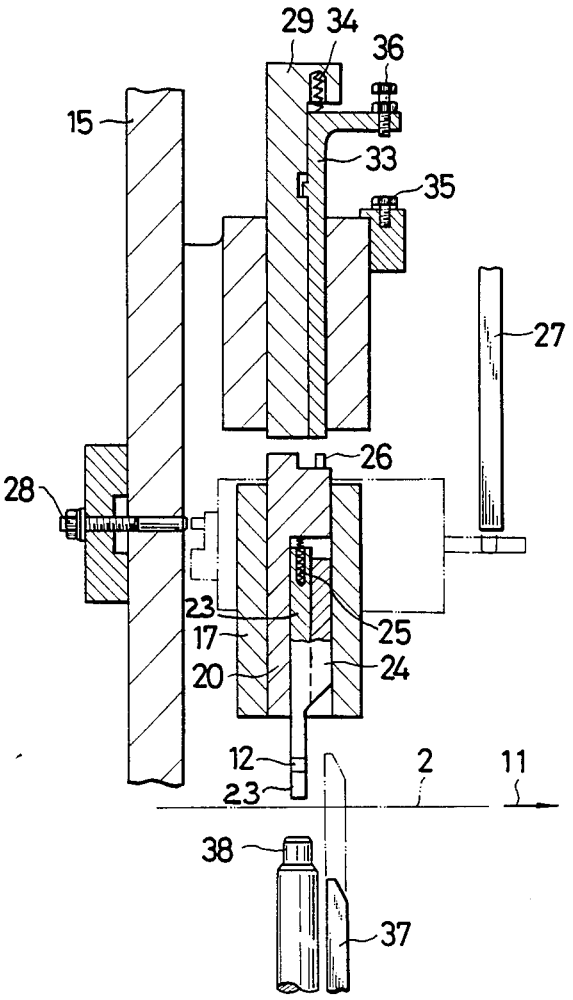
FIG. 2 is a fragmentary sectional side elevational view of the apparatus.
Figure 3:
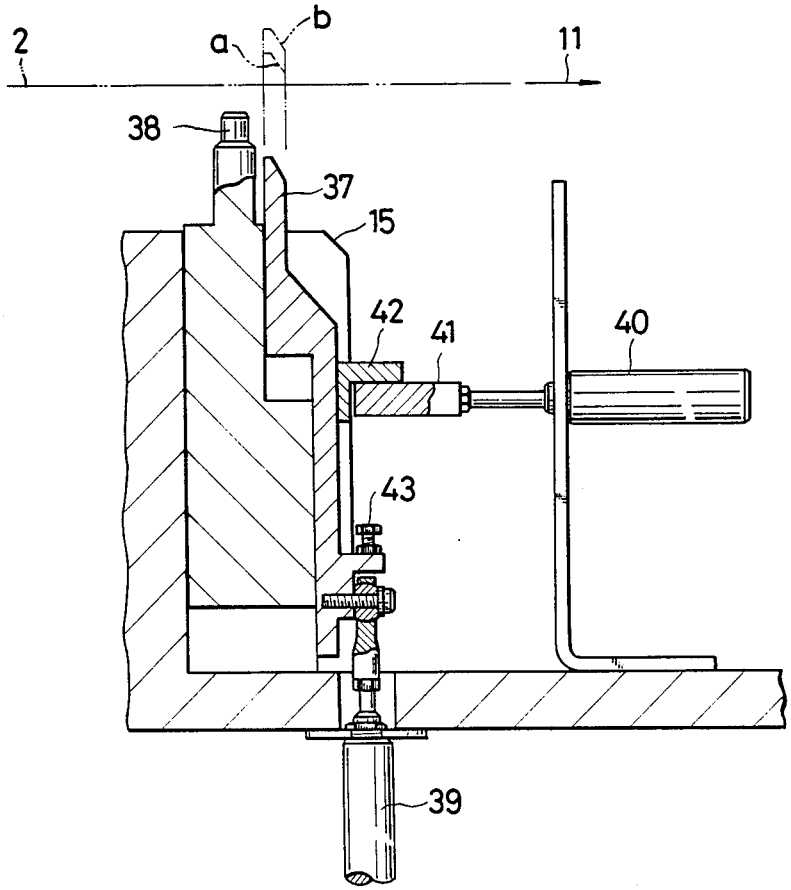
FIG. 3 is a fragmentary sectional side elevational view of the apparatus, showing a pusher rod and a thrust lever.

An apparatus for attaching top end stops to a slide fastener chain according to the present invention is illustrated in detail in FIGS. 1 through 3. The slide fastener chain 2 to which top end stops are to be attached is intermittently fed horizontally along a feed path 11 (FIG. 2). The apparatus includes a pair of pockets 12 disposed above the feed path 11 for gripping the top end stops 1 respectively therein, the pockets 12 being operatively associated with a moving means 13 and a lifting/lowering means 14, which will be described in detail below.

As shown in FIG. 1, the moving means 13 includes a rotatable shaft 16 horizontally supported in a frame 15 perpendicularly to the feed path 11. A case 17 is fixed to one end of the shaft 16, and an arm 18 is fixedly mounted on the other end of the shaft 16, the arm 18 being operatively coupled to a first cylinder 19. The first cylinder 19 is actuated to move its piston rod vertically to cause the arm 18 and the shaft 16 to turn the case 17 from a horizontal position to a vertical position. A holder 20 is movably disposed in the case 17 so that the holder 20 is vertically movable when the case 17 is in the vertical position. The holder 20 is normally urged to move upwardly by a tension spring 21, but limited against upward movement by a stop pin 22. A punch 23 and a pair of dies 24 are mounted on the lower end of the holder 20, the punch 23 and the dies 24 being slightly movable in the vertical direction. The punch 23 has a lower end of an inverted trapezoidal shape having a pair of laterally spaced upper end surfaces facing the lower ends of the dies 24, respectively. The lower ends of the dies 24 and the upper end surfaces of the punch 23 jointly define a pair of pockets or recesses 12 therebetween for gripping top end stops 1 therein. As shown in FIG. 2, the punch 23 is normally biased to move downwardly by a compression spring 25 acting on the holder 20. A pair of sensor pins 26 (only one shown in FIG. 2) is operatively coupled to the respective dies 24, the sensor pins 26 projecting upwardly from a stepped upper end of the holder 20. The dies 24 are normally urged to move downwardly by springs (not shown).

The case 17 is shown as being in the horizontal position indicated by the two-dot-and-dash lines in FIG. 2. When the case 17 is in the horizontal position, the pockets 12 are positioned near a top end stop supply chute 27 for receiving the respective top end stops 1 from the supply chute 27. When the pockets 12 grip the top end stops 1, the dies 24 are slightly pressed back into the holder 20 to push out the sensor pins 26 into contact with a first sensor 28 mounted on a frame 15, which then detects the receipt of the top end stops 1 by the pockets 12 and issues a signal to actuate the first cylinder 19. The first sensor 28 and the sensor pin 26 serve as contacts of a switch mechanism which can be turned on when the contacts contact each other while a small electric current is flowing through the frame 15.

The pockets 12 are supplied with the top end stops 1 from the supply chute 27 and then turned downwardly to the position directly above the feed path 11 for attachment of the top end stops 1 to the slide fastener chain 2.

As shown in FIGS. 1 and 2, the lifting/lowering means 14 includes a slide ram 29 vertically movably supported on the frame 15 in confronting relation to the holder 20 when the case 17 is in the vertical position, the slide ram 29 being vertically movable by the second cylinder 30. The slide ram 29 has a recess 31 defined in a vertically intermediate portion and opening laterally. A ram stopper 32 is slidably supported horizontally in the frame 15 and has a distal end which is movable into the recess 31 by a cylinder (not shown) coupled to the ram stopper 32 when the slide ram 29 is lowered to its limit. The ram stopper 32 can thus hold the slide ram 29 in its lower limit position. As shown in FIG. 2, a sensor lever 33 is vertically slidably supported on the slide ram 29 so that the sensor lever 33 confronts the sensor pin 26 when the case 17 is in the vertical position, the sensor lever 33 being normally urged to move downwardly by a spring 34 acting on the slide ram 29. The sensor lever 33 has a feeler 36 in the form of a bolt which is engageable with a second sensor 35 fixedly mounted on the frame 15.

When the case 17 is in the vertical position, the sensor pins 26 slightly project upwardly beyond the upper surface of the holder 20 if the top end stops 1 are reliably held in the pockets 12. Upon downward movement of the slide ram 29, the sensor lever 33 is slightly raised with respect to the slide ram 29 by the sensor pins 26. The holder 20 is lowered to a prescribed level as the slide ram 29 is lowered. At this time, the feeler 36 does not engage the second sensor 35, which produces an OFF signal to allow the apparatus to operate continuously. In the event that no top end stops are held in by the pockets 12, the sensor lever 33 is not lifted relatively to the slide ram 29, and the feeler 36 contacts the second sensor 35 to generate an ON signal for thereby stopping the apparatus.

The apparatus also includes a thrust lever 37 normally disposed below the feed path 11 for thrusting movement between the stringer tapes 5, and a pusher rod 38 normally disposed below the feed path 11 in confronting relation to the punch 23. As shown in FIG. 3, the pusher rod 38 is vertically movably supported on the frame 15 and vertically movable by a cylinder (not shown). The thrust lever 37 has an upper end of triangular shape and is vertically movable by a third cylinder 39 supported on the frame 15. A stopper 41 is also supported on the frame 15 for horizontal movement toward and away from the thrust lever 37, the stopper 41 being actuatable by a fourth cylinder 40 mounted on the frame 15. The thrust lever 37 has a stop member 43 on a lower portion thereof for engaging the stopper 41. The stop member 43 is in the form of a bolt which is vertically adjustable in position. When the stop member 43 engages the stopper 41, the thrust lever 37 is limited in its upward movement to a first limit position indicated by the two-dot-and-dash lines a in FIG. 3. By retracting the stopper 41 away from the thrust lever 37, the thrust lever 37 is permitted to move upwardly beyond the first limit position a up to a maximum limit position indicated by the two-dot-and-dash lines b in FIG. 3.

A limit block 42 is mounted on the frame 15 for lessening shocks caused on the stopper 41 when the stop member 43 hits the stopper 41 thereby to prevent the stopper 41 from being damaged, and also serves to define the maximum limit position b for upward movement of the thrust lever 37.

Figure 4:
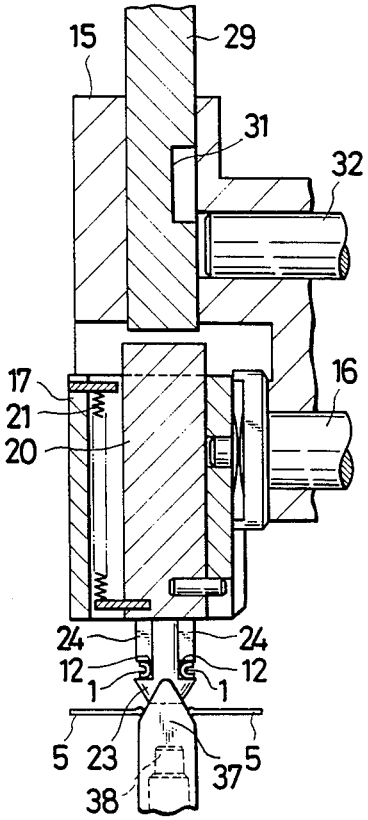
FIGS. 4 through 7 are fragmentary cross-sectional views showing a process of successive steps of attaching top end stops to a slide fastener chain.
Figure 5:
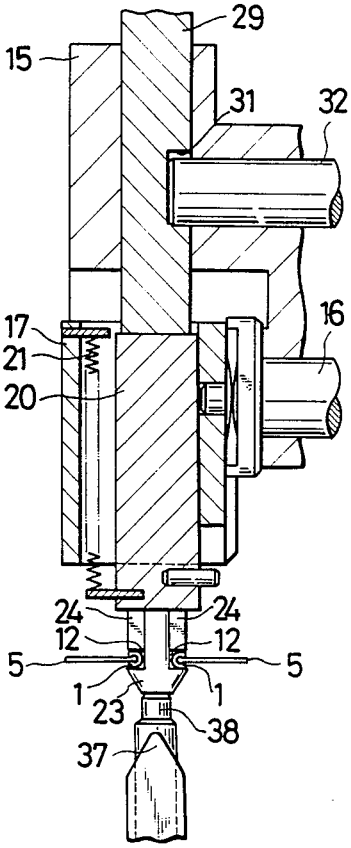

Now, a process of attaching the top end stops 1 to the slide fastener chain 2 will be described below. The top end stops 1 are supplied from the supply chute 27 into the respective pockets 12 when the case 17 is in the horizontal position. The case is then turned downwardly into the vertical position, after which the thrust lever 37 is lifted up to the first limit position a until the stop member 43 engages the stopper 41. This upward movement of the thrust lever 37 causes the triangular upper end of the thrust lever 37 to spread the stringer tapes 5 away from each other by the spacing or gap which is substantially the same as the interval or space between the top end stops 1 gripped in the pockets, as shown in FIG. 4. At this time, the stringer tapes 5 are held under tension. Then, the slide ram 29 is lowered to move the holder 20 downwardly for forcing the punch 23 to move between the stringer tapes 5 against the upward thrust of the pusher rod 38, whereupon the beaded edges of the stringer tapes 5 are snapped into the respective U-shaped top end stops 1. At this time, as shown in FIG. 5, the distal end of the ram stopper 32 engages in the recess 31 of the slide ram 29 to keep the holder 20 in the lowered position. Simultaneously, the thrust lever 37 is lowered to a retracted position shown in FIG. 5, and then the pusher rod 38 is elevated to lift the punch 23 for thereby clinching the top end stops 1 on the beaded edges of the stringer tapes 5 against the dies 24.

Figure 6:
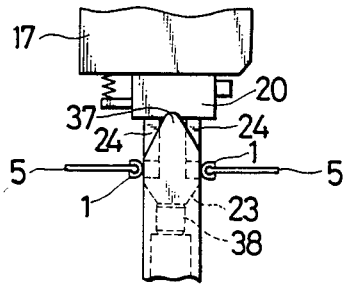
Figure 7:
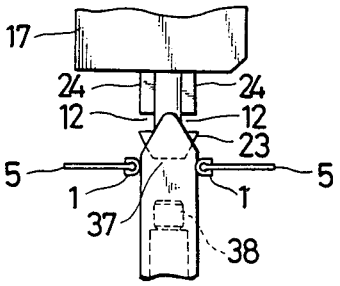

Thereafter, the thrust lever 37 is raised again until its full-width portion beneath the triangular upper end spreads the stringer tapes 1 away from each other to push the top end stops 1 fixed to the stringer tapes 5 out of the respective pockets 12, as illustrated in FIG. 6. Then, as shown in FIG. 7, the slide ram 29 is elevated and the pusher rod 38 is lowered. The holder 20 is lifted upwardly from between the stringer tapes 5 under the bias of the spring 21. The thrust lever 37 is also displaced downwardly. Thus, the top end stops 1 are applied to the slide fastener chain 2 as shown in FIG. 9. Top end stops can repeatedly be applied to the slide fastener chain 2 in the same manner as described above, while the slide fastener chain 2 is being intermittently fed along the feed path 11.

With the arrangement of the present invention, the stringer tapes 5 are only required to be spread by the triangular upper end of the thrust lever 37 apart from each other by a minimum gap or space which is about the same as the space between the top end stops 1 gripped in the respective pockets 12, when the top end stops 1 are to be attached to the stringer tapes 5. Therefore, the beaded edges of the stringer tapes 5 can reliably and quickly be inserted into the respective top end stops 1, and the top end stops 1 can be attached properly to the beaded edges. Accordingly, the top end stops 1 can be applied highly efficiently.

Obviously, various modifications and variations of the present invention are possible in the light of the above teaching. It is therefore to be understood that within the scope of the appended claims the invention may be practiced otherwise than as specifically described.

What is claimed is:

1. An apparatus for attaching a pair of top end stops to respective beaded edges of a pair of stringer tapes of a slide fastener chain which is fed along a feed path, said apparatus comprising:

a punch and die assembly disposed above said feed path and having a pair of pockets for gripping the top end stops, respectively, said punch and die assembly being movable between a first position for receiving the top end stops and a second position directly above an attaching position for attaching the top end stops to the stringer tapes;

moving means for moving said punch and die assembly from said first position to said second position;

lifting/lowering means for moving said punch and die assembly vertically between said second position and said attaching position across said feed path;

a thrust lever disposed below said feed path for spreading the stringer tapes away from each other; and a pusher rod disposed below said feed path for pressing said punch and die assembly to clinch the top end stops gripped in said pockets on the respective beaded edges of the stringer tapes.

2. An apparatus according to claim 1, wherein said punch and die assembly comprises a punch of an inverted trapezoidal shape having a pair of upper surfaces, and a pair of dies having lower surfaces facing said upper surfaces of said punch, said pockets being defined between said upper surfaces of said punch and said lower surfaces of said dies.

3. An apparatus according to claim 2, wherein said punch and die assembly includes a holder holding said punch and said dies, and a case in which said holder is movably supported, said case being angularly movable between said first and second positions.

4. An apparatus according to claim 3, wherein said lifting/lowering means includes a vertically movable slide ram positioned above said holder for pushing the holder from said second position toward said attaching position when said case is in said second position.

5. An apparatus according to claim 1, wherein said thrust lever has a triangular upper end for spreading the stringer tapes by a gap which is about the same as the distance between the top end stops gripped in said pockets.

* * * * *